US007440814B2

(12) United States Patent
McPherson et al.

(10) Patent No.: US 7,440,814 B2
(45) Date of Patent: Oct. 21, 2008

(54) METHOD FOR AUTO-CALIBRATION OF A TOOL IN A SINGLE POINT TURNING MACHINE USED FOR MANUFACTURING IN PARTICULAR OPHTHALMIC LENSES

(75) Inventors: Edward McPherson, Asslar (DE); Marc Savoie, Wetzlar (DE)

(73) Assignee: Satisloh GmbH, Wetzlar (DE)

( * ) Notice: Subject to any disclaimer, the term of this patent is extended or adjusted under 35 U.S.C. 154(b) by 351 days.

(21) Appl. No.: 11/415,048

(22) Filed: May 1, 2006

(65) Prior Publication Data

US 2006/0253220 A1 Nov. 9, 2006

(30) Foreign Application Priority Data

May 6, 2005 (EP) ..... 05009894

(51) Int. Cl.
*G06F 19/00* (2006.01)
*B24B 1/00* (2006.01)

(52) U.S. Cl. ..... 700/174; 451/42

(58) Field of Classification Search ..... 700/174–176; 451/5, 42–44, 240, 255–256, 277, 323; 702/85
See application file for complete search history.

(56) References Cited

U.S. PATENT DOCUMENTS

| | | | | |
|---|---|---|---|---|
| 4,016,784 | A | 4/1977 | Brown | |
| 4,083,272 | A | 4/1978 | Miller | |
| 4,417,490 | A | 11/1983 | Mochizuki | |
| 4,656,896 | A | 4/1987 | Bietz et al. | |
| 5,035,554 | A | 7/1991 | Nickols | |
| 5,785,651 | A | 7/1998 | Kuhn et al. | |
| 5,825,017 | A | 10/1998 | Pryor | |
| 5,934,972 | A * | 8/1999 | Gottschald | 451/5 |
| 6,071,176 | A | 6/2000 | Kuris | |
| 7,099,260 | B2 * | 8/2006 | Tanaka et al. | 369/112.26 |
| 2002/0155787 | A1 * | 10/2002 | Luderich | 451/5 |
| 2004/0058625 | A1 * | 3/2004 | Ben-Menachem et al. | 451/42 |
| 2004/0263840 | A1 * | 12/2004 | Segall et al. | 356/243.1 |
| 2005/0260343 | A1 * | 11/2005 | Han | 427/164 |

FOREIGN PATENT DOCUMENTS

| | | |
|---|---|---|
| EP | 0 500 218 A1 | 8/1992 |
| WO | WO 99/33611 | 7/1999 |
| WO | WO 02/06005 A1 | 1/2002 |

* cited by examiner

*Primary Examiner*—Zoila E Cabrera
(74) *Attorney, Agent, or Firm*—Reising, Ethington, Barnes, Kisselle, P.C.

(57) ABSTRACT

A method for auto-calibration of at least one tool (36) in a single point turning machine (10) used for manufacturing in particular ophthalmic lenses (L) is proposed, in which a test piece of special, predetermined geometry is cut with the tool and then probed to obtain probe data. The method subsequently uses the probe data to mathematically and deterministically identify the necessary tool/machine calibration corrections in two directions (X, Y) and three directions (X, Y, Z), respectively, of the machine. Finally these corrections can be applied numerically to all controllable and/or adjustable axes (B, F1, X, Y) of the machine in order to achieve a (global) tool/machine calibration applicable to all work pieces within the machines operating range. As a result two-dimensional (2D) tool/machine calibration and three-dimensional (3D) tool/machine calibration, respectively, can be performed in a reliable and economic manner.

20 Claims, 6 Drawing Sheets

Z Y

X Z

Y
X
40
62
B
66
70
40
68
69
64

72
Y
L
L
Z
44
40
40
44
B
36
72
36
24

Y
Z
74
36
B
78
44
82
80
36
81
76
44

METHOD FOR AUTO-CALIBRATION OF A TOOL IN A SINGLE POINT TURNING MACHINE USED FOR MANUFACTURING IN PARTICULAR OPHTHALMIC LENSES

FIELD OF THE INVENTION

The present invention relates to a method for auto-calibration of a tool in a single point diamond turning (SPDT) machine used for manufacturing in particular ophthalmic lenses. Such machine is disclosed in, e.g., document WO-A-02/06005 by the same inventors.

SPDT is a well known method for generating non-rotationally symmetrical surfaces commonly used for ophthalmic eyeglass lenses. The surfaces are typically of toric or toroidal shape, or of completely freeform shape, such as those used in progressive addition lenses (PALs) One common problem encountered in these SPDT machines is a small, but unacceptable error at the center of rotation of the lens. These errors are typically caused by errors of calibration, causing the tool to not quite reach, or stop within acceptable tolerances from the center of rotation.

BACKGROUND OF THE INVENTION

In the prior art there is no lack of proposals as to how the tool/machine calibration may be realized. In a first, very common method a tool height to center calibration (Z-direction) is performed by scribing a test part with the tool while the test part is prevented from rotation. Typically two lines are scribed, the first at a given angular position (B-angle), then a second line at a second fixed B-angle 180 degrees from the first B-angle. The distance between the two lines is measured with an optical microscope with an appropriate magnification and measurement reticule. The tool height is then manually adjusted by half the measured distance between the two lines, and the procedure is repeated until no separation between the lines can be observed. Finally a test lens is cut and the center is examined using an optical microscope. Small adjustments to the final calibration can be made at this stage.

The disadvantages with this first method are those of accuracy and repeatability being variable, and speed being slow and unpredictable. The speed and success of the whole procedure is typically dependent on operator experience and skill. Further, this is a tool height calibration only. The method does not lend itself to identifying the center and/or radius of the tool tip. This needs to be achieved using a different method. Also, another problem with this first method is possible damage to the tool during the scribing part of the procedure. Finally, this is only a partial tool calibration, offering Z-height only, and still requires final test piece verification/adjustment using an optical microscope.

A second method as disclosed in, e.g., the "NANOFORM® SERIES OPERATOR'S MANUAL" of Precitech Inc., Keene, N.H., USA, uses a special camera accurately positioned relative to the spindle of the machine. The optical axis of the camera is generally parallel to the Z-axis. The camera is mounted at a known and repeatable position in all three (X, Y, and Z) directions relative to the machine spindle (headstock), typically using a kinematic coupling interface to allow for quick insertion and removal of the camera into/from the machine. The camera optics are typically using a very short focal depth of field, and the position of this focal plane needs to have been previously pre-adjusted and fixed in order to perfectly coincide with the center of the spindle rotation axis (Z-height). The camera's image is electronically displayed on a computer monitor or other suitable output device to allow for viewing by the operator. The camera optics are adjusted and fixed so the camera's focus (on the tool's rake face) is used to adjust the Z-height of the tool relative to the axis of rotation. The tool height is manually adjusted by the operator by turning an adjustment screw until the tool is brought into focus. This provides a preliminary tool height (Z) calibration. At this point, the operator can move the tool relative to the image using his X, Y jog capability, and visually aligns three different points on the edge of the tool with the cross hairs of the imaging system. These points are captured numerically by the computer system, and used to calculate a best fit circle corresponding to the cutting edge of the tool.

The tool height obtained with focus was said to be a preliminary height (Z) adjustment only. As a final step to obtain a good tool height calibration, a rotationally symmetrical test piece is cut, and its center is observed by the operator using an optical microscope. Depending on what is observed at the center of this test piece a corresponding adjustment is made to the tool height. This final test piece cutting and observation procedure normally needs to be repeated until the operator is satisfied he has achieved a good calibration.

The disadvantages with this approach are those of speed, and operator involvement. Also, unless many hundreds of points along the tool edge are captured at sub-micron accuracies, which is not practical at all, the method cannot automatically calibrate for tool tip circularity errors. Standard practice therefore typically involves purchasing of more expensive "controlled waviness" tools, i.e. very precise tools with low deviation from the best fit circle.

Another problem with this approach is identified when the tool tip has a "blunt edge". Blunt edge tools are used in special cases where certain types of material respond better to high negative rake situations. In these cases it is common to use a slightly chamfered or radiused edge treatment so that the actual cutting point of the tool tip can be located many microns below the rake face of the tool. In this case, measuring the height of the tool using a focus point on the rake face does not properly identify the height of the true point at which the tool cuts; and accurately focussing at the very edge is quite difficult.

Again, the second method is only a partial calibration since it does not calibrate for circularity errors, and also requires final test piece verification/adjustment using an optical microscope.

Other optical based methods and apparatus used to do a tool/machine calibration are described in documents U.S. Pat. No. 5,825,017 and U.S. Pat. No. 4,656,896. These methods, however, have the same disadvantages as described above.

A third method uses touch probes to probe the tool in different directions, either on or off the machine. Different documents describe mechanisms and variations of this approach, including U.S. Pat. No. 5,035,554, U.S. Pat. No. 4,417,490, U.S. Pat. No. 4,083,272 and U.S. Pat. No. 4,016,784. However, none of these methods calibrate for tool tip radius, or circularity. In addition, like was the situation with the second method, tool height cannot be accurately determined if the tool has a blunt edge since only the rake face is mechanically probed.

Applicable to all the above methods is a procedure commonly used to improve the form accuracy of precision optical surfaces. This method is described in literature from Moore Nanotechnology Systems, LLC, Keene, N.H., USA, regarding a "Workpiece Measurement & Error Compensation System (WECS™)", and again Precitech Inc., Keene, N.H., USA, concerning the "ULTRACOMP™ Form Measurement & Error Compensation System". This technology is typically a "part dependent" error measurement and compensation procedure, and as such it is applied to only one part geometry at a time. By this it is meant that after a part is cut, the errors are measured on that part, and then error compensation is applied when the part is recut. If a different part, with different geometry is cut, the full procedure is repeated for the new part. This means it is not a general machine calibration meant to be used on any geometry, but is rather geometry specific.

This procedure has the disadvantage that it is slow and time consuming to apply, due to the fact that it needs to be repeated for each part geometry to be cut. Also, this method only maps errors on one side of center, meaning it does not consider the possibility of cutting parts with prism, i.e. parts having a surface which is tilted with respect to the axis of rotation. Thirdly it is not a calibration method which lends itself to a general tool/machine calibration including Z-height errors. The machine needs to be pre-calibrated and cutting accurately to center before this method can be implemented.

Summarily, the current state of the art uses methods which are based on manual, operator dependent procedures, and are therefore prone to errors, provide for partial tool calibration only and/or are slow in their implementation and practice.

Therefore, what is needed is a method for auto-calibration of a tool in a single point turning machine used for manufacturing in particular ophthalmic lenses, by which two-dimensional (2D) tool/machine calibration and three-dimensional (3D) tool/machine calibration, respectively, can be performed in a reliable and economic manner.

SUMMARY OF THE INVENTION

According to one aspect of the present invention there is provided a method for auto-calibration of at least one tool in a single point turning machine used for manufacturing in particular ophthalmic lenses, wherein a cutting edge is formed on the tool which has a three-dimensional shape and position relative to width (X), length (Y) and height (Z) directions of the machine, which method comprises the steps of:

(i) cutting with the tool a test piece of rotationally symmetrical geometry about an axis of work rotation requiring both positive and negative tool contact angles with the cutting edge;

(ii) probing the cut geometry of the test piece at points which required positive and negative tool contact angles to obtain probe data, and storing the probe data;

(iii) analyzing the probe data in respect of deviations of the cut geometry from the geometry which should have been cut in the width (X) and length (Y) directions to obtain X-errors and Y-errors, and storing the errors; and (iv) automatically controlling the machine to correct for the width errors and length errors.

In this way a reliable and economic two-dimensional (2D) tool/machine calibration is performed. A particular advantage of this method consists in the fact that, due to the test piece geometry cut and probed, the geometry of the cutting edge on both sides of the center of the cutting edge is taken into consideration in the calibration of the machine. This is of particular importance to the calibration if (optical) surfaces shall be cut that have prism at the center of rotation in which case the cutting edge comes into cutting engagement with the surface to be cut on both sides of center of the cutting edge.

The step of cutting the test piece may include cutting a circular groove in the face of the test piece, as an advantageously simple test piece geometry. Further, the step of probing the cut geometry of the test piece can include capturing probe data along a straight line starting on one side of the test piece, and extending through to the other side of the test piece while passing through or close by the axis of work rotation, as an easy-to-perform probing procedure. When probing the cut geometry of the test piece the probe data is preferably captured in a continuous fashion, i.e. the probe is first brought into contact with the test piece and the probe contact with the test piece is then maintained using a low but constant force, while moving the test piece relative to the probe or vice versa.

As far as the step of analyzing the probe data is concerned, it may include executing best fit analysis of the probe data to determine best circle fit of test piece geometry which should have been cut through the test piece geometry actually cut, and determining width offset and length offset of the tool by comparing actual to theoretical results. In this instance the step of controlling the machine preferably includes controlling, by CNC, X- and Y-axes of the machine to correct for width offset and length offset.

Furthermore, the step of analyzing the probe data can include executing best fit analysis of probe data to determine best fit geometry through the general geometry of the cutting edge, and determining tool waviness errors in the length (Y) direction relative to slope of tool contact angle between the cutting edge and the test piece, to compensate for deviations in the tool tip radius. In this case the step of controlling the machine preferably includes identifying the tool contact angle for every given point on a surface to be cut, and adjusting the tool in the length (Y) direction by adding or subtracting, respectively, the tool waviness error in the length direction at the corresponding tool contact angle.

According to a further aspect of the present invention there is provided a method for auto-calibration of at least one tool in a single point turning machine used for manufacturing in particular ophthalmic lenses, wherein a cutting edge is formed on the tool which has a three-dimensional shape and position relative to width (X), length (Y) and height (Z) directions of the machine, which method comprises the steps of:

(i) cutting with the tool a test piece of rotationally asymmetrical geometry about an axis of work rotation with the cutting edge;

(ii) probing the cut geometry of the test piece at least at a portion having a slope in a direction of rotation about the axis of work rotation to obtain probe data, and storing the probe data;

(iii) analyzing the probe data in respect of deviations of the cut geometry from the geometry which should have been cut in the width (X), length (Y) and height (Z) directions to obtain width errors, length errors and height errors, and storing the errors; and (iv) automatically controlling the machine to correct for the width errors, length errors and height errors.

In this way a reliable and economic three-dimensional (3D) tool/machine calibration is performed. A particular advantage of this method consists in the fact that, with the test piece geometry cut and probed, significantly more information about tool calibration to center can be obtained to compensate for even errors in the Z-direction.

In this instance the step of cutting the test piece may include cutting a geometry which is axisymmetric along two axes in the X-Z plane on the face of the test piece. Moreover, the step of probing the cut geometry of the test piece can include capturing probe data at a given radial distance from the axis of work rotation while rotating the test piece about the axis of work rotation, preferably over an angle of 360 degrees, as an easy-to-perform probing procedure.

Again, when probing the cut geometry of the test piece the probe data is preferably captured in a continuous fashion.

Regarding the step of analyzing the probe data the height error is preferably determined from a phase error in the axis of work rotation.

As far as the step of controlling the machine is concerned, which may comprise a fast tool device carrying the tool and having a fast tool axis inclined with respect to a Y-axis of the machine, it preferably includes controlling, by CNC, the fast tool axis (and/or the Y-axis) to correct for height errors, without requiring any special means for height error compensation.

In both cases (2D and 3D calibration) the step of probing the cut geometry of the test piece may finally include probing the latter with a mechanical probe preferably mounted on the machine, and capable of measuring along the length (Y) direction of the machine.

BRIEF DESCRIPTION OF THE DRAWINGS

The invention will be explained in more detail below on the basis of preferred examples of embodiment and with reference to the accompanying diagrammatic drawings, in which.

DETAILED DESCRIPTION OF THE PREFERRED EMBODIMENTS

Figure 1:
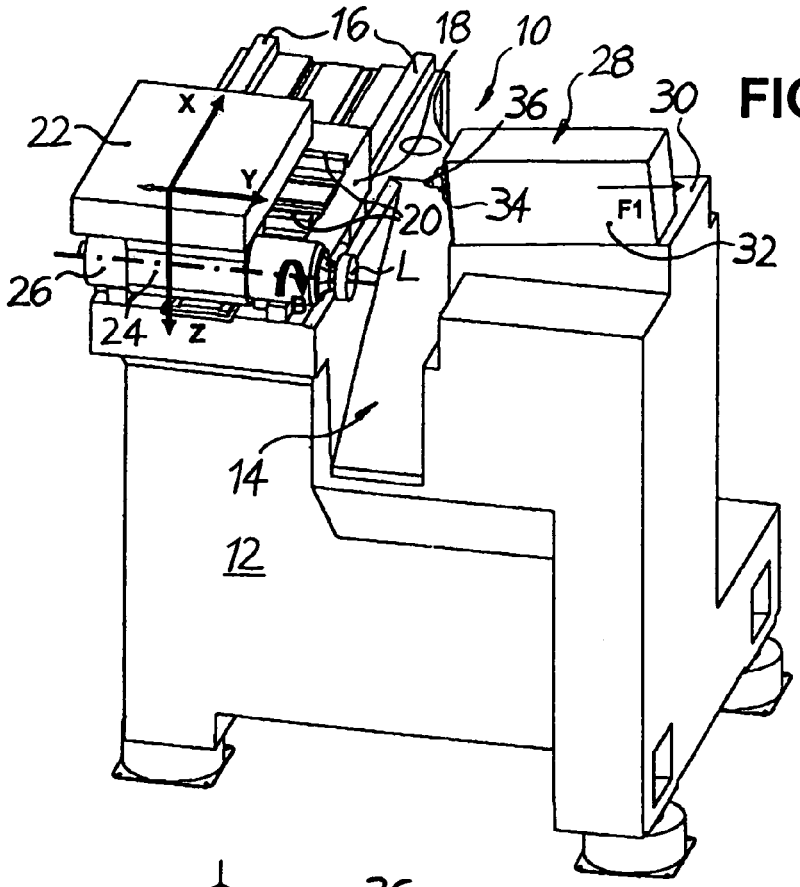
FIG. 1 shows a single point turning machine in which a tool/machine calibration according to the present invention can be performed, in a diagrammatic, perspective view, indicating in particular the axis convention used throughout the specification.
Figure 2:
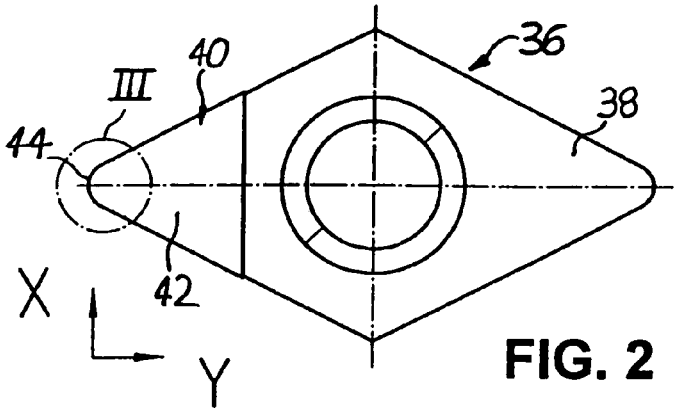
FIG. 2 shows a diagrammatic top view of a turning tool used in the single point turning machine according to FIG. 1, in a scale enlarged in relation to reality.

FIG. 1 shows a CNC-controlled single point turning machine 10 in particular for surface machining of plastic spectacle lenses L. The single point turning machine 10 has a frame 12 defining a machining area 14. On the left of the machining area 14 in FIG. 1 two guide rails 16 extending horizontally and parallel to each other are attached to an upper surface of the frame 12. An X-carriage 18 displaceable horizontally in both directions of an X-axis by assigned CNC drive and control elements (not shown) is mounted slidably on the two guide rails 16. Two further guide rails 20 extending horizontally, parallel to each other and perpendicular to the guide rails 16 are attached to an upper surface of the X-carriage 18. In a cross slide table arrangement a Y-carriage 22 displaceable horizontally in both directions of a Y-axis by assigned CNC drive and control elements (likewise not shown) is mounted slidably on the two further guide rails 20. Attached to a lower surface of the Y-carriage 22 is a work spindle 24 which can be driven to rotate about an axis of work rotation B, with the speed and the angle of rotation controlled by CNC, by means of an electric motor 26. The axis of work rotation B is generally aligned with the Y-axis. For machining of the prescription surface of the spectacle lens L, the latter, blocked on a blocking piece (not shown), is mounted on the end of the work spindle 24 extending into the machining area 14, in a manner known in the art, in such a way that it can rotate coaxially with the work spindle 24. Finally, the arrow marked Z indicates the height direction of the single point turning machine 10 which is perpendicular to both the X-axis and the Y-axis.

On the right of the machining area 14 in FIG. 1 a so-called "fast tool" device 28 is mounted on an upper surface 30 of the frame 12 which is inclined towards the machining area 14 with respect to the horizontal direction. As is known from, e.g., document WO-A-02/06005 the fast tool device 28 comprises an actuator 32 and a shuttle 34. The shuttle 34 is axially movable in both directions of a fast tool axis F1 by the actuator 32, with the stroke controlled by CNC (other fast tool axes can be added but are not necessary in connection with the present invention; these axes would be called F2, F3, etc. and would generally be mounted parallel to the fast tool axis F1). A lens turning tool insert 36 (typically a diamond tool) is secured to the shuttle 34 in a manner known in the art. In this connection it should be mentioned that each fast tool axis typically holds one cutting insert, however a second insert can be mounted if the fast tool shuttle is adapted with a special two headed insert holder.

Figure 3:
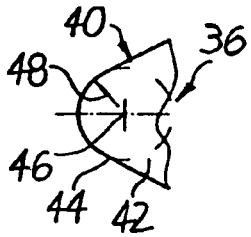
FIG. 3 shows an enlarged top view of the cutting edge of the turning tool represented in FIG. 2, according to the detailed section III in FIG. 2.
Figure 4:
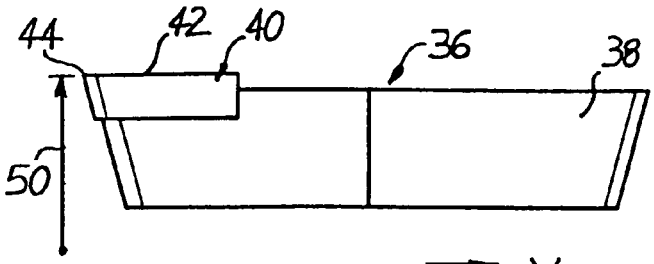
FIG. 4 shows a diagrammatic side view of the turning tool represented in FIG. 2, viewed from below in FIG. 2.
Figure 5:
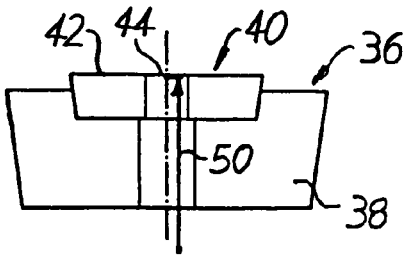
FIG. 5 shows a diagrammatic front view of the turning tool represented in FIG. 2, viewed from the left in FIG. 4.

Further details of the lens turning tool insert 36 are shown in FIGS. 2 to 5. The lens turning tool insert 36 comprises a basic body 38 via which it can be fixed detachably on the shuttle 34 of the fast tool device 28. A tool or cutting tip 40 is attached to an upper face of the basic body 38. The tool tip 40 has a rake face 42 and a cutting edge 44 which is circular at least in theory and, as indicated earlier, may be located below the rake face 42 (blunt edge). While the cutting edge 44 is shown as having a circular form it may also have a different definable geometry. In FIG. 3 reference number 46 designates the center of tool tip 40, i.e. of the cutting edge 44, whereas reference number 48 designates the radius of tool tip 40, i.e. of the cutting edge 44. The height of the cutting edge 44 in the Z-direction in the system of coordinates of the single point turning machine 10 will be referred to as tool height 50 in the following, as indicated in FIGS. 4 and 5.

With respect to the structure of the single point turning machine 10 it remains to be noted that a mechanical probe (not shown) may be provided on the right of the machining area 14 in FIG. 1 for probing the work piece L. Alternatively a suitable optical probe may be used. The probe (either mechanical or optical) should be capable of measuring along the Y-direction. It should preferably be mounted beside the F1-axis, and would generally have its axis of measurement parallel to the X-Y-plane, or parallel to the X-F1-plane. The probe height should generally be centered on the X-B-plane, i.e. centered on the work piece rotation center. Alternatively a probe tip can be mounted on one of the F1- or F2-axes, to be more precise on the shuttle 34 of the fast tool device 28, and this can be used as a mechanical probe.

The present invention is mostly concerned with calibration of the position of the tool tip 40 relative to the center of rotation of the work piece L, and also relative to the position of the surface of the work piece L at the center of rotation. Since this is a three dimensional problem, the calibration needs to consider and adjust for tool tip position errors in all three dimensions. The following is simply an explanation of the error, and the effect of this error in each of the three directions X, Y, and Z.

Figure 6:
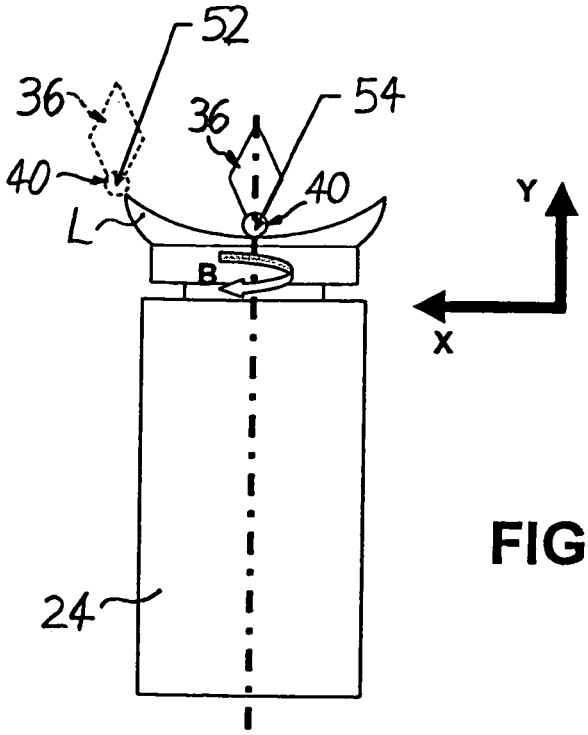
FIG. 6 shows a diagrammatic top view of a work spindle of a single point turning machine and its turning tool, in which a lens (illustrated in cross-section) attached to the work spindle and the turning tool are in turning engagement, for explaining errors in the X-direction.

At first the errors in the X-direction will be explained with reference to FIGS. 6 to 9. Essentially the X-direction is more commonly referred to as the cross feed or spiral infeed direction. For a given lens L, the tool tip 40 would typically be positioned to start at an X-position just outside the outer diameter of the lens L, then feed towards the center until it reaches the center of rotation of the lens L. This is illustrated in FIG. 6, in which reference number 52 is assigned to the position of the tool tip 40 at the beginning of the cut, whereas reference number 54 is assigned to the position of the tool tip 40 at the end of the cut. Alternatively, the infeed of the tool tip 40 could begin at the center and end at the edge of the lens L.

Figure 7:
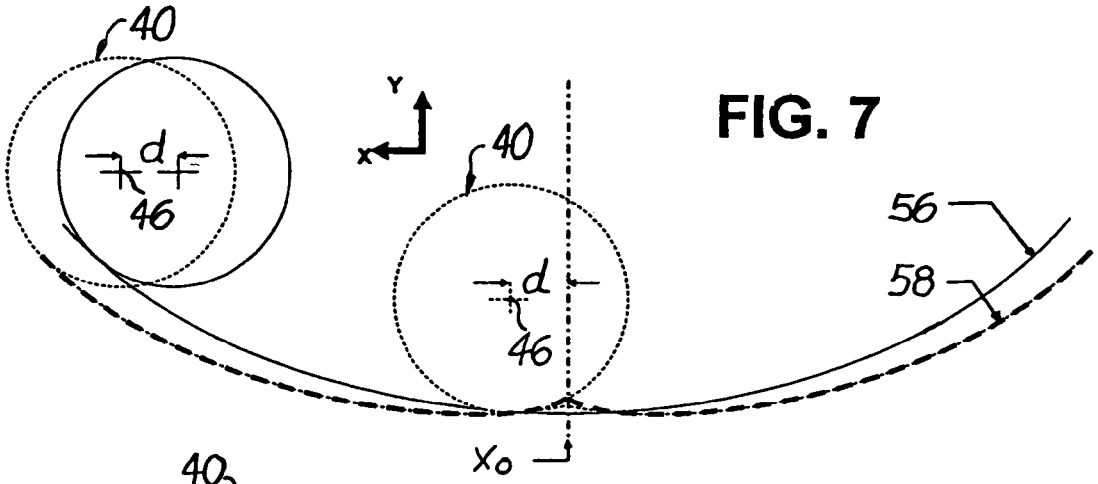
FIGS. 7 to 9 show diagrammatic views of the tool tip of the turning tool according to FIG. 6 and of the surface of the cut lens, for illustrating errors in the X-direction.
Figure 8:
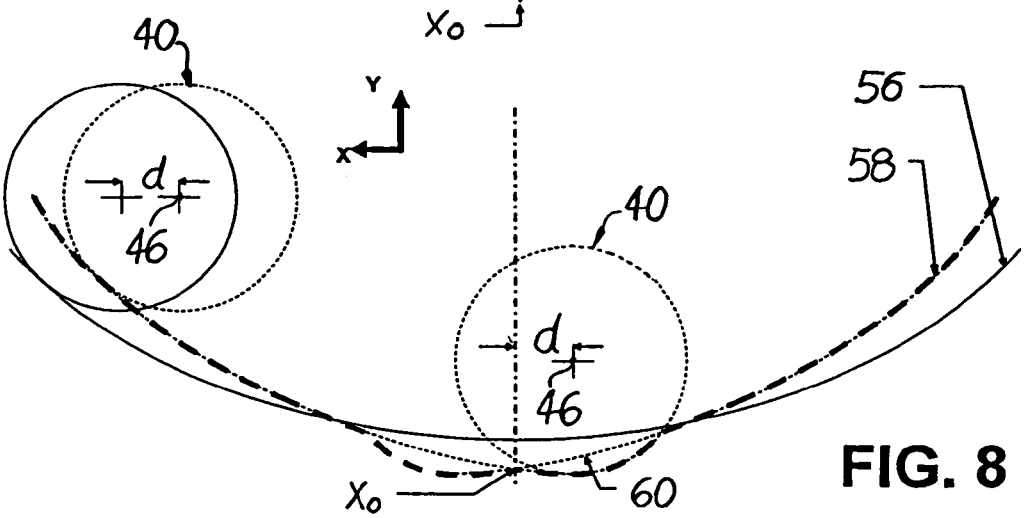

It should be quite apparent that the position of the tool tip 40 in the X-direction at the center of the lens L is quite critical to achieve good lens geometry. This can be more clearly seen in FIGS. 7 and 8, in which $x_0$ designates the position of the true center, i.e. of the rotation axis of the lens L, whereas d designates the difference (offset error) between the geometric center 46 of the tool tip 40 and the lens rotation axis ($x_0$), when the tool tip 40 is thought to be precisely at $x_0$. Whereas FIG. 7 illustrates an offset d to the left, FIG. 8 shows an offset d to the right. In both cases the solid line at 56 indicates the theoretical surface of the lens L with perfect calibration, i.e. $x=x_0$, whereas the dashed line at 58 indicates the actual surface of the lens L with bad calibration when $x=x_0+d$ (FIG. 7), or $x=x_0-d$ (FIG. 8). In the case at 60 there is also a situation when the tool tip 40 is past center where material is forced under the tool tip 40 from the reverse side of the cutting edge 44.

The above figures are representative of concave surfaces, however similar errors will be experienced with convex surfaces. For purposes of clarity, the above described errors will be referred to as a "first order" error.

Yet another distinct situation caused by errors of tool positioning in the X-direction will be experienced when the surface being cut has prism at the center of rotation, i.e. a surface (portion) which is tilted with respect to the axis of rotation. This will be referred to as a "second order" error, and is graphically illustrated in FIG. 9, in which theoretically perfect tool tip and calibration are shown at 62 (solid line circle), whereas a shift in center caused by bad calibration is illustrated at 64 (dashed line circle). Further, the surface of the lens L at a rotation angle of 180 degrees is shown at 66, and the surface of the lens L at a rotation angle of zero degrees is shown at 68. The dashed line 69 represents the tool path. The heavy black line now indicates the final surface of the lens L, whereas the solid thin line indicates the desired surface of the lens L.

Figure 9:
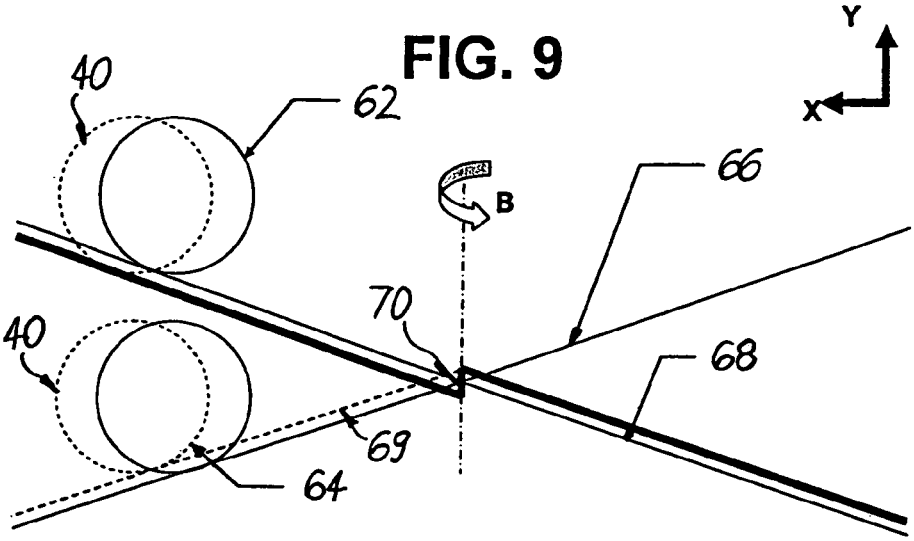

As becomes apparent from FIG. 9 the tool tip 40 cuts deeper than desired at a rotation angle of zero degrees, and higher than desired at a rotation angle of 180 degrees. Note the discontinuity 70 at the center of rotation which is directly attributable to an offset error in the X-direction.

Figure 10:
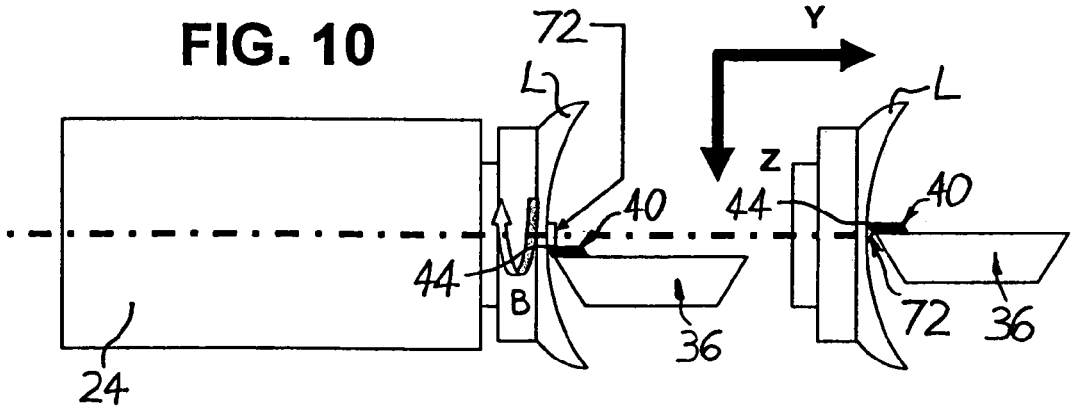
FIG. 10 shows a diagrammatic side view of a work spindle of a single point turning machine and its turning tool, in which a lens (illustrated in cross-section) attached to the work spindle and the turning tool are shown at the end of the cut, for explaining errors in the Z-direction.

The errors in the Z-direction will now be explained with reference to FIGS. 10 and 11. Two types of errors are generally seen in the Z-direction, the first and simplest, is a tool height to center error. This will simply leave an uncut (or partially cut) center peak 72 at the center of rotation. This is easily illustrated with a Y-Z-plane cross-sectional view of the lens L as shown in FIG. 10. Note that the cutting edge 44 of the tool tip 40 can either be too high (lens L at right), or too low (lens L at left) relative to the center of rotation of the lens L (shown greatly exaggerated).

Again, FIG. 10 essentially shows what is referred to as a "first order" error, and again a "second order" error will be experienced when the lens L has prism at the center of rotation. In this case, as shown in FIG. 11, the error will have a similar appearance to that described with reference to FIG. 9, but will however be rotated by 90 degrees in B-axis angle.

Figure 11:
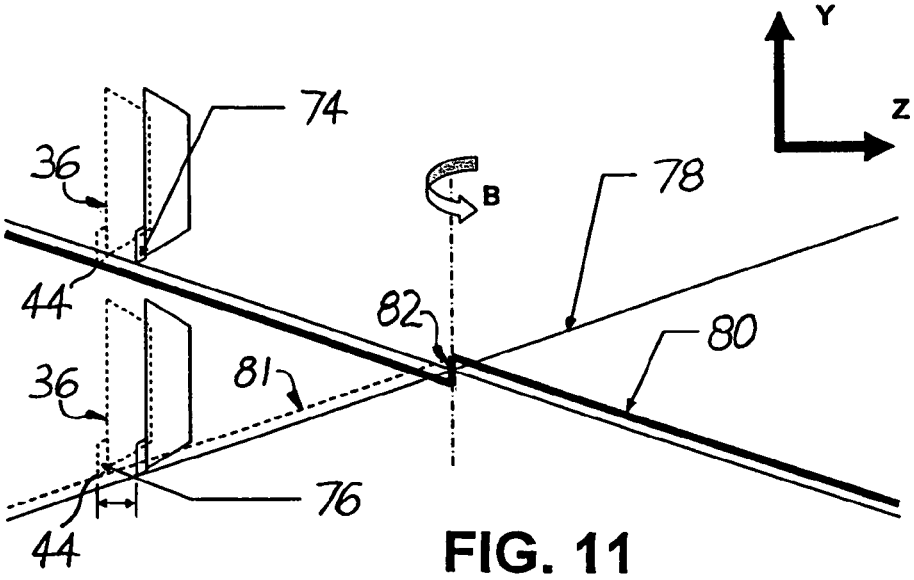
FIG. 11 shows a diagrammatic view of the turning tool according to FIG. 10 and of the surface of the cut lens, for illustrating errors in the Z-direction.

In FIG. 11 theoretically perfect tool and calibration are shown at 74 (solid line), whereas a shift in the position of the cutting edge 44 caused by bad calibration is illustrated at 76 (dashed line). Further, the surface of the lens L at a rotation angle of 270 degrees is shown at 78, and the surface of the lens L at a rotation angle of 90 degrees is shown at 80. The dashed line 81 represents the tool path. Again, the heavy black line indicates the final surface of the lens L, whereas the solid thin line indicates the desired surface of the lens L.

As is clear from FIG. 11 the tool 36 cuts deeper than desired at a rotation angle of 90 degrees, and higher than desired at a rotation angle of 270 degrees. Note again the discontinuity 82 at the center of rotation which is directly attributable to an offset error in the Z-direction.

The errors in the Y-direction will now be explained with reference to FIGS. 12 and 13. Again, in the Y-direction "first order" and "second order" errors can be distinguished. "First order" errors will simply affect the thickness of the lens L. "Second order" errors are however experienced when prism at the center is cut into the surface. As was the case with the "second order" errors coming from other axes directions, these errors are typically much smaller than their "first order" counterparts. To further illustrate this, one can understand that a small thickness error in the order of a few microns to up to over 100 microns would have no significant effect on the optics of the lens L. Standard industry tolerances for ophthalmic lens thickness are typically limited to +/−0.1 mm (100 microns) for practical considerations of cosmetics, and/or structural strength of the lens L. The power change however for this amount of thickness change would be less than 0.01 of a diopter for all powers between +/−20 diopters.

When prism at the center of the lens L is present however, the final surface can easily have small, unacceptable errors at the center caused by Y-axis position differences from nominal. A significant source of error comes from variations in tool radius 48 (see also FIG. 3) from a best fit circle. FIG. 12 illustrates how the edge circularity of the cutting tip 40 can vary from the best fit circle 84 (tool waviness), wherein reference number 86 designates a typical departure from the true circular form, which can quite easily be up to 5 microns. In this connection it should be noted that for clarity reasons the error has been shown as magnified, however the typical errors are no greater than a few microns.

Figure 13:
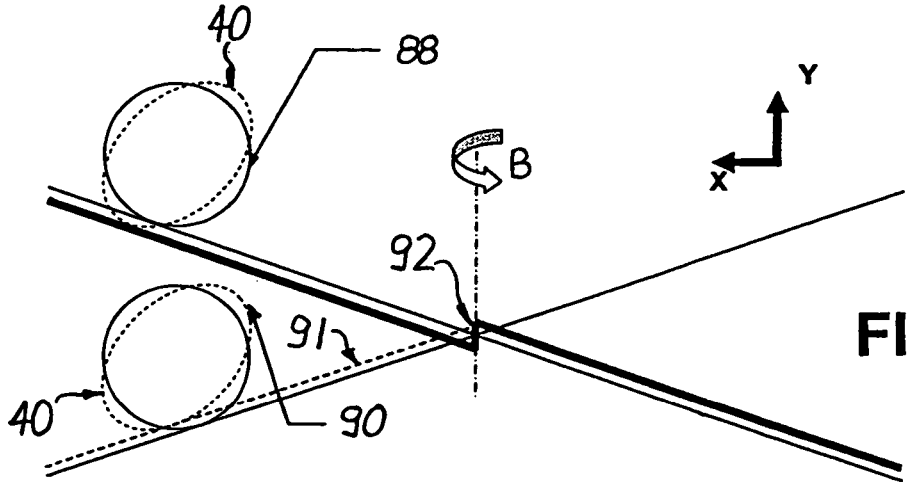
FIG. 13 shows a diagrammatic view of the tool tip of a turning tool and of the surface of the cut lens, for illustrating errors in the Y-direction.

The effect of an error in tool shape is finally illustrated in FIG. 13, with the error shown greatly exaggerated. In FIG. 13 theoretically perfect tool (nominal tool diameter) and calibration are shown in solid line at 88. The actual tool shape and the actual cutting path are shown in dotted lines at 90 and 91, respectively. The final surface is represented by the heavy black line, and again presents a discontinuity 92 at the center of rotation.

In the following a method for two-dimensional (2D) tool calibration in the X- and Y-directions will be explained with reference to FIGS. 14 to 18, by which the errors in the X- and Y-directions as described above can be corrected.

Figure 14:
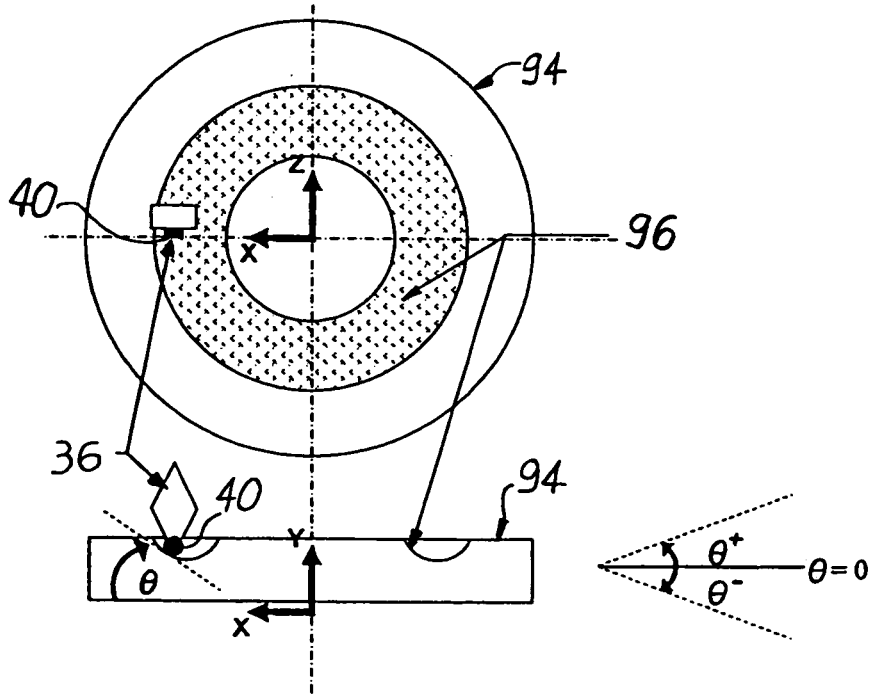
FIG. 14 is a sketch illustrating the turning of a test piece having a predetermined geometry, as a first step of a 2D tool calibration in the X- and Y-directions.

In a first step of the 2D calibration concept a rotationally symmetrical test piece 94 as shown in FIG. 14 is cut. A specific characteristic of this test piece 94 is that it requires both positive and negative tool contact angles (angle θ as shown in FIG. 14) to generate the geometry of the test piece 94 so that the cutting edge 44 of the tool tip 40 comes into cutting engagement with the test piece 94 on both sides of the center of tool tip 46 (see FIG. 3) in the X-direction. In the example of embodiment shown in FIG. 14 the test piece 94 is cut in its surface with a predefined circular groove 96. The test cut shown is rotationally symmetrical about the axis of work rotation B. The groove 96 is cut assuming the bottom will be round (toric shape) when cut with a tool 36 having a perfectly round tool tip 40 or a tool with known and accurate geometry, and as viewed relative to a radial axis running through the center of rotation.

Figure 15:
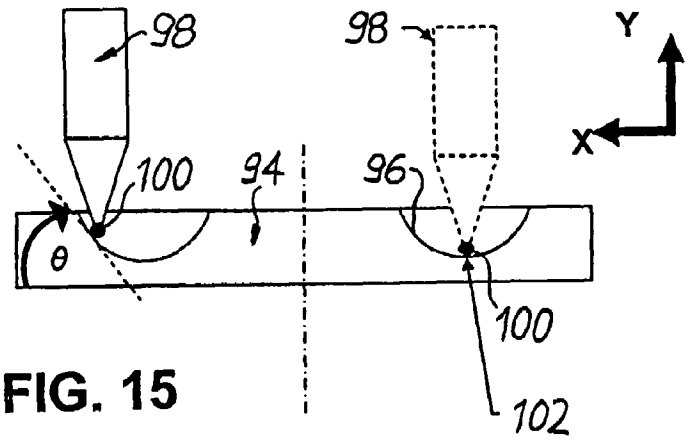
FIG. 15 is a sketch illustrating the probing of the test piece according to FIG. 14 to measure deviations from the perfect shape, as a second step of the 2D tool calibration in the X- and Y-directions.

Then, as shown in FIG. 15 representing the test piece 94 in a cross sectional view, the test piece 94 is probed with a precision probe 98 which may be arranged at the turning machine 10, as explained above, to measure the shape of the cut surface, and the probe data is stored. In FIG. 15 a probe 98 with a spherical probe tip 100 is used to measure the geometry of the test piece 94, in particular of the groove 96. Basically, the probe tip 100 touches the surface of the test piece 94, and the positions of the machine axes are recorded at each probe point to give two dimensional information about the probed surface in this case.

In this instance it is sufficient to capture probe data along a straight line starting on one side of the test piece 94, and extending through to the other side of the test piece 94 while passing through (or close to) the center of rotation. This is done while holding position on the axis of work rotation B and moving the X-axis. By doing so probe data is obtained which is representative of test piece geometry which has been cut not only by an area of the cutting edge 44 on one side of center 46 in the X-direction but also by an area of the cutting edge 44 on the other side of center 46 in the X-direction. Although this could be achieved also by probing only one side of the test piece 94, e.g. the side to the left of the center line of the test piece 94 in FIG. 15, probing both sides of the test piece 94 is preferred to compensate for errors in location of the probe 98 relative to the axis of work rotation B. Alternatively the test piece 94 could be probed as stated first, i.e. on both sides of the test piece 94, then rotated by 180 degrees and probed again. This procedure would offer the advantage to compensate for errors due to an inclined position of the test piece 94 with respect to the axis of work rotation B. This inclined position could occur in a case in which the test piece 94 has been removed from the machine 10 after cutting and is probed off the machine 10 for instance. As a further alternative a spiral probe path could be followed by adding B-axis motion during the X-axis move.

In this connection it should further be mentioned that, generally, the preferred method of probing consists of first bringing the probe 98 into contact with the test piece 94 and maintaining probe contact with the test piece 94 using a low but constant force, then moving one or more machine axes in order to move the test piece 94 relative to the probe 98 so that the test piece 94 is probed continuously. During this process encoder positions of all relevant axes are simultaneously captured (using hardware latching). Thousands of points can be captured in a few seconds, with each individual point being comprised of the simultaneous individual positions of two, three or more axes.

A variation to the above could be accomplished in a non contact fashion using an optical probe such as the "Distance Measuring Confocal Microscope" described in document U.S. Pat. No. 5,785,651, or the "Confocal Chromatic Displacement Sensor" sold by Stil S.A., France.

Probing could also be done on a point by point basis, wherein a mechanical probe is physically brought into contact with the test piece being measured, and the positions (encoder readings) of all relevant axes are simultaneously captured (latched) when probe contact with the test piece is detected. The probe is then lifted from the surface of the test piece, axes are moved, and the process is repeated to obtain a new probe point so that the test piece is probed step by step.

It remains to be noted with respect to FIG. 15 that reference number 102 designates the point at the bottom of the cut (center of cut) where the tool contact angle θ is zero, i.e. where the slope of the geometry cut is zero.

In a further step of the 2D calibration concept the obtained probe data is analyzed with respect to calibration errors in the X- and Y-directions, and optionally with respect to shape errors of the cutting edge 44 in particular in the Y-direction (tool radius deviation or tool waviness). This will be explained in the following with reference to FIGS. 16 to 18.

Figure 16:
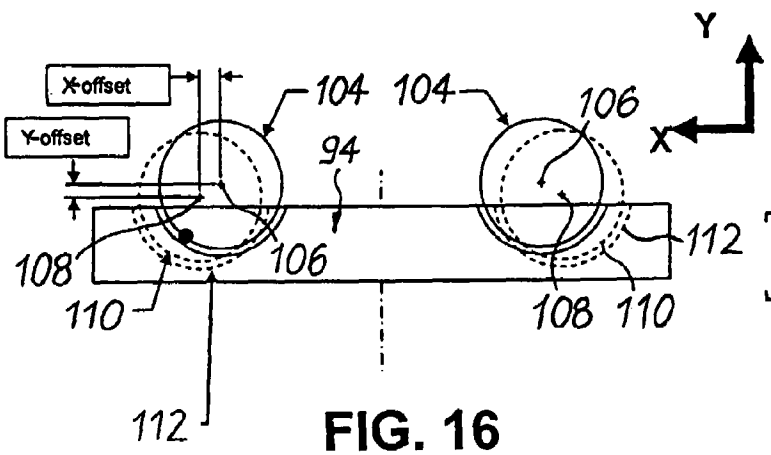
FIG. 16 is a sketch illustrating how the data obtained by probing the test piece according to FIG. 15 is analyzed with respect to calibration errors in the X- and Y-directions, as a third step of the 2D tool calibration in the X- and Y-directions.

At first the probe data is fitted to a probe circle 104 as shown in FIG. 16, i.e. a known circle fit through the probe points is carried out. Then the center 106 of the probe circle 104 is compared to the center 108 of an ideal probe circle 110 fitting a theoretical cut 112 assuming perfect calibration. The ideal probe circle 110 has the same center 108 as the center of the theoretical cut 112, and the radius of the ideal probe circle 110 is the radius of the theoretical cut 112 minus the radius of the spherical probe tip 100. The difference in position of the center 106 of the probe circle 104 with respect to the center 108 of the ideal probe circle 110 gives the calibration errors in the X- and Y-directions. These errors are designated with "X-offset" and "Y-offset" in FIG. 16.

After fitting the probe circle 104, additional information can be obtained with respect to shape errors of the cutting edge 44. Errors in radius 48 of the turning tool insert 36 (see FIG. 3) give errors in radius of the circle through the probe points. Waviness of the turning tool insert 36 can be found from errors from the best fit circle 84 (see FIG. 12).

Figure 17:
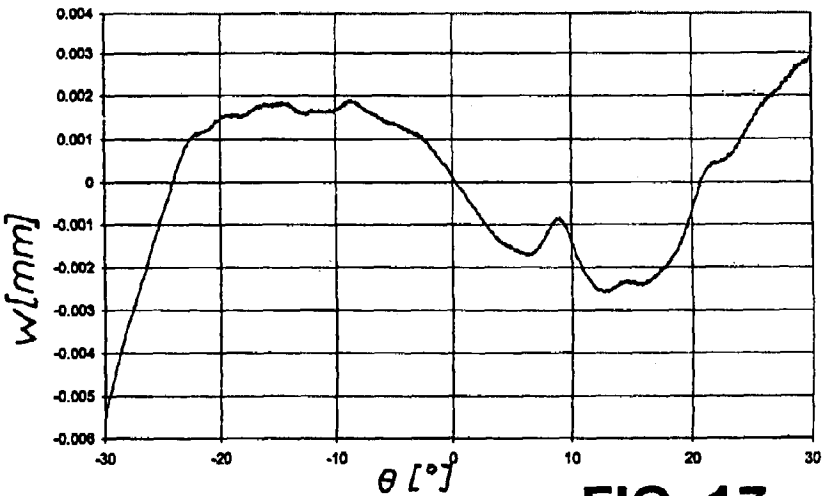
FIGS. 17 and 18 are graphs obtained from actual probe data gathered from a test piece cut with a circular groove as represented in FIGS. 14 to 16, illustrating the error in the Y-direction due to departures from the best fit circle of the tool tip geometry (tool waviness)
Figure 18:
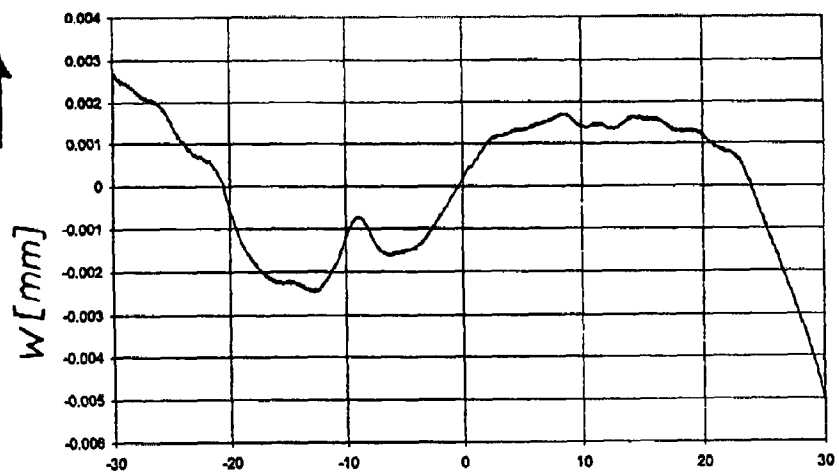

The two graphs shown in FIGS. 17 and 18 were obtained from actual probe data gathered from the test piece 94 cut with the circular groove 96 according to FIGS. 14 to 16. In these graphs the height w (in mm) of the probe 98 above the best fit circle 104 in the Y-direction is shown as a function of the angle θ (in degrees) from the center of cut 102. Whereas FIG. 17 represents the results obtained by probing the circular groove 96 on the right side of the center line of the test piece 94 in FIG. 15, FIG. 18 shows the results obtained by probing the groove 96 on the left side of the center line of the test piece 94 in FIG. 15. The departure from the best fit circle 104 as measured from right, then left side of center is quite apparent from these graphs. Note the mirror symmetry of the two graphs. This is an indication of good measurement repeatability and accuracy using this probing technique.

In this connection it should be mentioned that the probe 98 needs (and assumes) an accurate spherical ball tip 100. Here one could purchase a very accurate, well qualified probe tip, or conversely use an inexpensive ball tip that is then used to probe a highly accurate test sphere or other suitable reference geometry. The results can then be used to correct any inaccuracies of the ball tip.

Figure 12:
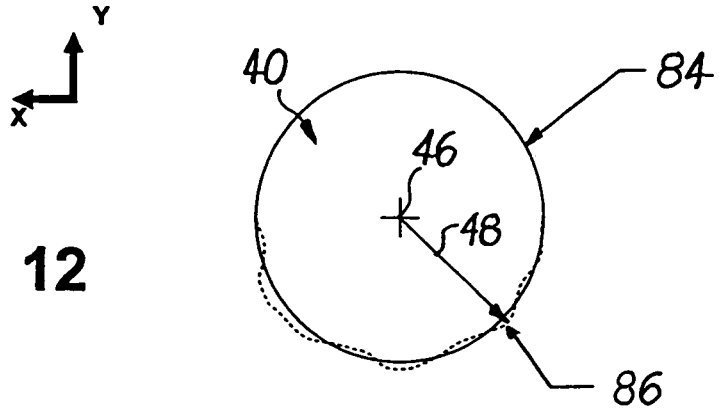
FIG. 12 shows an enlarged top view of the cutting edge of a turning tool, in a scale enlarged in relation to reality, for illustrating errors in the Y-direction.

The data obtained during probing of the test piece 94 can be used further to execute a best fit analysis in order to determine a best fit circle 84 through the general tool tip 40 geometry (best fit of tool tip radius 48 to a circle as illustrated in FIG. 12), and then to determine tool waviness errors, i.e. deviations of the radius of tool tip 48 from the best fit circle 84, relative to the slope of the tangent angle θ between the tool tip 40 and the test piece 94 (see FIGS. 17 and 18).

Finally the results of the above analyses are stored in appropriate memory registers and/or data files, and can be used for suitably controlling the X- and Y-axes of the single point turning machine 10 to correct for X- and Y-errors, both "first order" errors and "second order" errors.

To be more precise the X- and Y-offsets are provided to correct for tool center 46 to rotation center (axis of work rotation B) distance errors. In order to correct for shape errors of the cutting edge 44, firstly, the angle θ (slope of the surface to be cut) at the point of contact of the tool tip 40 for every calculation point is identified. Secondly, for each calculation point, the height of the tool in the Y-direction is adjusted by the amount of waviness error determined on the basis of the data obtained during the probing of the test piece 94. In other words, tool tip (Y-height) errors can be corrected for by determining the theoretical tool position at a given point on the (optical) surface to be cut, calculating the tangent angle θ at this point, and adding (or subtracting) the deviation of true tool tip 40 from best fit 84 tip radius at the corresponding tangent angle θ in the tool error file.

Summarily, as a simple first step tool calibration, two different calibration elements can be obtained. The first is tool calibration relative to the X- and Y-axes, i.e. relationship between center 46 of tool, and center of work rotation (axis of work rotation B), while the second is relative to tool tip radius deviation respectively tool roundness measurement/calibration. In brief, to achieve these calibrations the following steps need to be followed:

- Cut test piece 94 of rotationally symmetrical geometry requiring both positive and negative tool contact angles θ (FIG. 14).
- Probe the above test piece 94 geometry and store the probe data obtained (FIG. 15).
- Execute best fit analysis of probe data to determine best fit of theoretical test piece geometry 112 through the actual geometry (FIG. 16).
- Determine X-offset by comparing actual to theoretical results; determine Y-offset by comparing actual to theoretical results (FIG. 16).
- Execute best fit analysis of probe data to determine best fit circle 84 through the general tool tip 40 geometry (best fit of tool tip radius to a circle).
- Analyze probe data to determine tool waviness errors in the Y-direction relative to slope of tangent angle θ between tool tip 40 and test piece 94 (results similar to FIGS. 17 and 18).
- Store results of above analyses in appropriate memory registers and/or data files.
- Use results by appropriately controlling the machine's X- and Y-axes to correct for X- and Y-errors.

At this point it is to be noted that the above described 2D calibration does not correct for Z-axis errors. This algorithm assumes a pre-calibrated Z tool height to center. The following three-dimensional (3D) calibration includes Z height calibration.

By cutting a more complex test piece, significantly more information about tool calibration to center can be obtained. In this instance, if a test piece is cut and probed that is rotationally asymmetrical, information about calibration errors in all 3 dimensions, i.e. X, Y, and Z can be obtained. The important aspect here is that the additional Z-dimension calibration is obtained.

Figure 19:
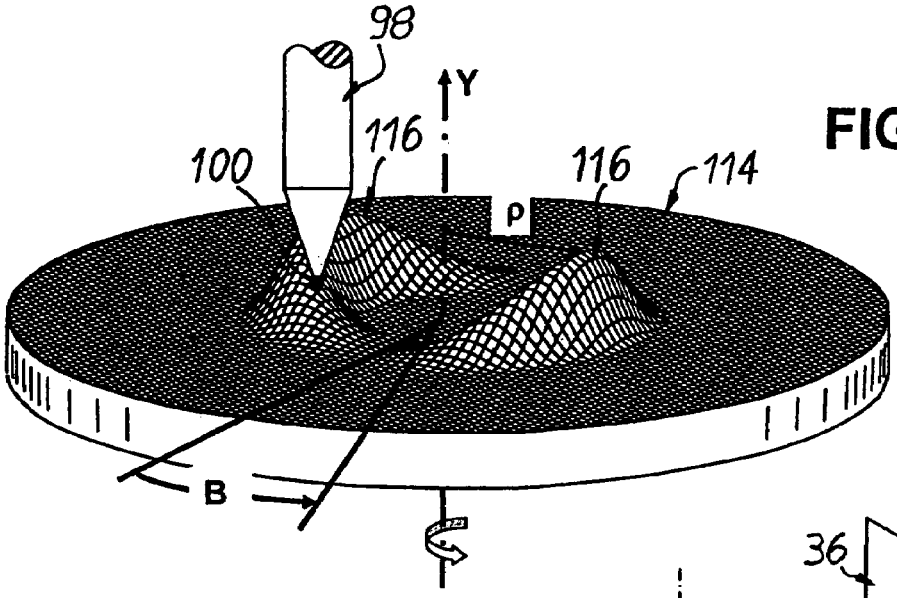
FIG. 19 shows a perspective view of an example of a test piece having a rotationally asymmetric shape that could be used for 3D tool calibration in the X-, Y- and Z-directions.
Figure 20:
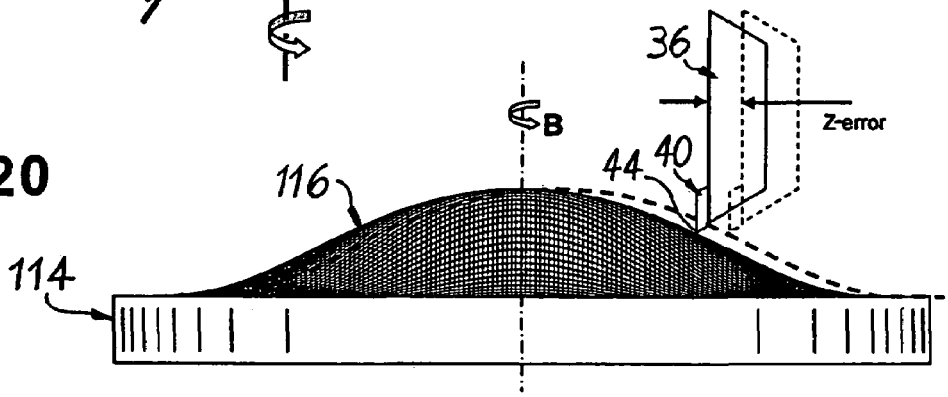
FIG. 20 shows a side view of the test piece according to FIG. 19, and FIGS. 21 and 22 are representations of Y plot vs. B-angle at a given constant radius ρ for the geometry of the test piece shown in FIGS. 19 and 20, for illustrating how an error in the Z-direction results to a rotational (phase) error in B-axis.

FIGS. 19 and 20 show an example of a test piece 114 having a rotationally asymmetric shape that could be used to provide full 3D error measurements. The surface shown in FIGS. 19 and 20 is axisymmetric along two horizontal axes, however one could imagine a surface that is non axi-symmetric—a "worm" or "sausage" shape for instance—that could be used to achieve similar results, or conversely, a surface which is axi-symmetric along one horizontal axis, e.g. a plane surface tilted with respect to the axis of work rotation, used in conjunction with a different surface such as the rotationally symmetric surface of FIG. 14 in order to achieve the same results.

The surface shown in FIGS. 19 and 20 can be expressed by the following equation:

$$Y = f(B, \rho) = h \cdot (1 + \sin[a \cdot (\rho - \rho_0)]) \cdot (1 + \sin[nB])$$

$$\text{2. find } \left(\frac{-\pi}{2a} + \rho_0, \rho_0\right) \text{ and } \left(\frac{3\pi}{2a} + \rho_0\right)$$

where:

- a is a constant controlling width of bump 116 in radial direction (ρ);
- h is a constant controlling height of feature(s) above surface;
- ρ is the radial distance from center of rotation;
- B is the angle about axis of rotation; and
- n is the number of bumps 116 (integer; n=2 in the case shown).

From the side view of the non-rotationally symmetrical surface of the test piece 114 shown in FIG. 20 it becomes apparent how an error in the Z-direction ("Z-error" in tool height calibration) would lead to what would appear as a rotational (phase) error in B-axis. In FIG. 20 the theoretically perfectly calibrated turning tool 36 is represented with solid lines, whereas a shift of the turning tool caused by bad calibration in the Z-direction is illustrated with dashed lines.

Figure 21:
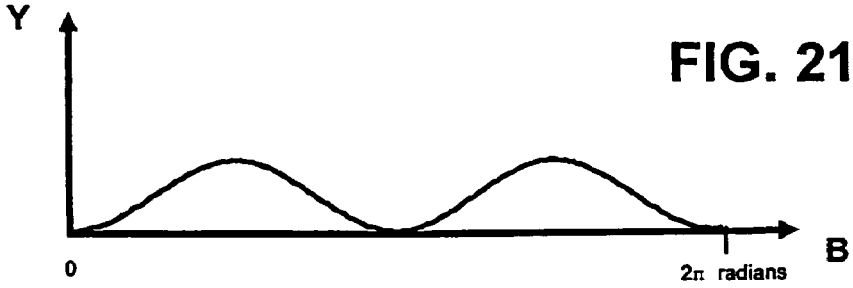
Figure 22:
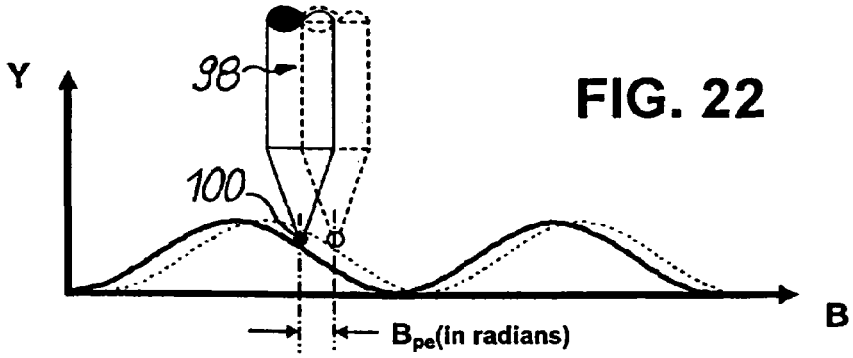

FIG. 21 is a representation of (error free) Y plot vs. B-angle at a given constant radius ρ for the geometry shown in FIGS. 19 and 20, whereas FIG. 22 illustrates probing of this geometry at a given constant radius ρ while rotating the test piece 114 about the axis of work rotation B. Probing the test piece 114 over a short sector, e.g. ten degrees, would be sufficient to obtain the probe data required for Z-calibration, even probing a point would do it in theory provided the surface is probed at a slope. However, probing the test piece 114 while it makes one full revolution about the axis of work rotation B is preferred as more data is obtained that allows for a verification of the results of probing. Again, the dashed lines in FIG. 22 refer to the shape with the "Z-error", whereas the solid lines represent the theoretically perfect shape. $B_{pe}$ (in radians) indicates the phase error that equals the "Z-error" according to FIG. 20 divided by ρ, i.e.

$$\Delta Z=\rho\cdot B_{pe}$$

A 3D fitting can now be carried out either in two steps or in one step, as will be explained in the following.

As far as 3D fitting in two steps is concerned, if a solution is found in 2D first, the solution to the third dimension can be achieved independently to the 2D solution. In this instance a solution of simultaneous equations would be limited to the 2D case, and in a separate step a solution to the third dimension, with different probing data. To achieve these calibrations the following steps need to be followed:

- Cut test piece 114 of appropriate, rotationally asymmetrical geometry.
- Probe test piece 114 along a straight line going through high points of test geometry, e.g. along B=90 degrees in FIG. 19, and store probe data.
- Analyze probe data to determine (i) general tool tip 40 geometry (best fit tool tip radius), (ii) distance from center of best fit tool tip radius to center of lens rotation (in X-direction), and (iii) Y-errors relative to slope of tangent angle θ between the turning tool 36 and the test piece 114 (results similar to FIGS. 17 and 18).
- Probe test piece 114 while rotating it, e.g. at a fixed radius ρ over the peaks (bumps 116) of the shape, and store probe data.
- Analyze probe data to determine Z-direction distance of cutting edge 44 to center of axis of work rotation B.
- Store results of above analyses.

A 3D fitting in a single step can be carried out using least squares or another mathematical fitting algorithm. It is possible to fit the parameters defining the tool position and radius using, for example, a least squares fitting routine. One typical method would be to use an equation for the probe value Y written as a function of the machine position and calibration parameters for the surface:

$$Y_{calc}=F(X_i,B_i,\Delta X,\Delta Y,\Delta Z,\Delta r)$$

where:

$Y_{calc}$ is the calculated probe value
$X_i$ is the position of the X-axis at probe i
$B_i$ is the position of the B-axis at probe i
ΔX is the X-calibration error
ΔY is the Y-calibration error
ΔZ is the Z-calibration error
Δr is the tool tip radius error Then, a least squares routine (or other error minimization algorithm) will find the value of the fitting parameters (best value of ΔX,ΔY,ΔZ,Δr) to give a minimum error, Q, as defined by the following equation:

$$Q=\sum_{i=0}^{m}[Y_i-Y_{calc}]^2$$

To perform this estimate, probe data should be obtained over the surface, such as a spiral pattern of probing.

The tool waviness can be modeled with a function W vs. θ; where θ is the contact angle at the tool tip 40 (see FIG. 14), and "W" is the deviation from the best fit circle 104 as shown in FIGS. 17 and 18. This function could be a power series:

$$W=k_0+k_1\theta+k_2\theta^2+\ldots k_n\theta^n,$$

or a set of points (W, θ). The correction values can be found after the other parameters are fitted, by fitting the function to the error like that shown in one of FIG. 17 or 18.

Instead of finding the waviness of the tool tip 40 after the least squares fitting, it is possible to include a function defining the shape of the tool tip 40. The coefficients of the power series, or the points in the fitting, would be found as an output of the least squares fitting instead of a second process.

In brief, the results of the above fitting are used as follows:

Adjust machine 10 by ΔZ so cut will go to center.

Include offsets ΔX and ΔY in calculations of the cut path.

Identify the angle θ (slope of the work piece surface) at the point of contact of the tool 36 for every calculation point.

For every calculation point, adjust the height of the tool 36 (in the Y-direction) by the amount of error measured during the probing of the test piece 114, (i.e. W vs. θ). The amount of adjustment is found from either the power series, or by interpolation between points.

As far as the adjustment of the single point turning machine 10 by the Z-calibration error is concerned, it remains to be noted that this can be carried out easily by using the CNC-controlled F1-axis of the fast tool device 28 shown in FIG. 1. Since the latter is mounted on the inclined surface 30 of the frame 12, the axes F1 of the fast tool device 28 and Y of the work spindle 24 (horizontal axis) are inclined with respect to each other, so when the turning tool 36 is driven to move in the F1-direction it also moves in the Z-direction with respect to the lens L.

Finally it should be noted that, although the fast tool device 28 has been described as being a linear fast tool device 28, it is evident to the person skilled in the art that, basically, the proposed 2D and 3D calibration of the tool can also be carried out in connection with a standard ("slow") turning device or a rotative fast tool device as is known, e.g., from document WO-A-99/33611. Further, besides the above mentioned tool device the machine to be calibrated may have one or more further tool device(s), e.g. a tool device selected from a group comprising turning tool devices, milling tool devices, grinding tool devices etc.

A method for auto-calibration of at least one tool in a single point turning machine used for manufacturing in particular ophthalmic lenses is proposed, in which a test piece of special, predetermined geometry is cut with the tool and then probed to obtain probe data. The method subsequently uses the probe data to mathematically and deterministically identify the necessary tool/machine calibration corrections in two directions (X, Y) and three directions (X, Y, Z), respectively, of the machine. Finally these corrections can be applied numerically to all controllable and/or adjustable axes (B, F1, X, Y) of the machine in order to achieve a (global) tool/machine calibration applicable to all work pieces within the machines operating range. As a result two-dimensional (2D) tool/machine calibration and three-dimensional (3D) tool/machine calibration, respectively, can be performed in a reliable and economic manner.

Other variations and modifications are possible without departing from the scope and spirit of the present invention as defined by the appended claims.

We claim:

1. A method for auto-calibration of at least one tool in a single point turning machine used for manufacturing in particular ophthalmic lenses, wherein a cutting edge is formed on said tool which has a three-dimensional shape and position relative to width, length and height directions of said machine, said method comprising the steps of:

(i) cutting with said tool a test piece of rotationally symmetrical geometry about an axis of work rotation (B) requiring both positive and negative tool contact angles (θ) with said cutting edge;

(ii) probing the cut geometry of said test piece at points which required positive and negative tool contact angles (θ) to obtain probe data, and storing said probe data;

(iii) analyzing said probe data in respect of deviations of the cut geometry from the geometry which should have been cut in the width and length directions to obtain width errors and length errors, and storing said errors; and (iv) automatically controlling said machine to correct for said width errors and length errors.

2. The method according to claim 1, wherein the step of cutting said test piece includes cutting a circular groove in the face of said test piece.

3. The method according to claim 2, wherein the step of probing the cut geometry of said test piece includes capturing probe data along a straight line starting on one side of said test piece, and extending through to the other side of said test piece while passing through or close by said axis of work rotation.

4. The method according to claim 3, wherein the step of probing the cut geometry of said test piece includes capturing probe data in a continuous fashion.

5. The method according to claim 4, wherein the step of analyzing said probe data includes executing best fit analysis of said probe data to determine best circle fit of test piece geometry which should have been cut through the test piece geometry actually cut, and determining width offset and length offset of said tool by comparing actual to theoretical results.

6. The method according to claim 5, wherein the step of controlling said machine includes controlling, by CNC, width and length axes of said machine to correct for width offset and length offset.

7. The method according to claim 4, wherein the step of analyzing said probe data includes executing best fit analysis of probe data to determine best fit geometry through the general geometry of said cutting edge, and determining tool waviness errors in the length direction relative to slope of tool contact angle (θ) between said cutting edge and said test piece.

8. The method according to claim 7, wherein the step of controlling said machine includes identifying the tool contact angle (θ) for every given point on a surface to be cut, and adjusting said tool in the length direction by adding or subtracting, respectively, the tool waviness error in the length direction at the corresponding tool contact angle (θ).

9. The method according to claim 1, wherein the step of analyzing said probe data includes executing best fit analysis of probe data to determine best fit geometry through the general geometry of said cutting edge, and determining tool waviness errors in the length direction relative to slope of tool contact angle (θ) between said cutting edge and said test piece.

10. The method according to claim 9, wherein the step of controlling said machine includes identifying the tool contact angle (θ) for every given point on a surface to be cut, and adjusting said tool in the length direction by adding or subtracting, respectively, the tool waviness error in the length direction at the corresponding tool contact angle (θ).

11. A method for auto-calibration of at least one tool in a single point turning machine used for manufacturing in particular ophthalmic lenses, wherein a cutting edge is formed on said tool which has a three-dimensional shape and position relative to width, length and height directions of said machine, said method comprising the steps of:

(i) cutting with said tool a test piece of rotationally asymmetrical geometry about an axis of work rotation with said cutting edge;

(ii) probing the cut geometry of said test piece at least at a portion having a slope in a direction of rotation about said axis of work rotation to obtain probe data, and storing said probe data;

(iii) analyzing said probe data in respect of deviations of the cut geometry from the geometry which should have been cut in the width, length and height directions to obtain width errors, length errors and height errors, and storing said errors; and (iv) automatically controlling said machine to correct for said width errors, length errors and height errors.

12. The method according to claim 11, wherein the step of cutting said test piece includes cutting a geometry which is axisymmetric along two axes in the plane on the face of said test piece and perpendicular to the axis of work rotation.

13. The method according to claim 12, wherein the step of probing the cut geometry of said test piece includes capturing probe data at a given radial distance from the axis of work rotation while rotating said test piece about the axis of work rotation, preferably over an angle of 360 degrees.

14. The method according to claim 13, wherein the step of probing the cut geometry of said test piece includes capturing probe data in a continuous fashion.

15. The method according to claim 14, wherein the step of analyzing said probe data includes determining the height error from a phase error ($B_{pe}$) in the axis of work rotation.

16. The method according to claim 15, wherein said machine comprises a fast tool device carrying said tool and having a fast tool axis inclined with respect to a length axis of said machine, wherein the step of controlling said machine includes controlling, by CNC, said fast tool axis to correct for height errors.

17. The method according to claim 16, wherein the step of probing the cut geometry of said test piece includes probing the latter with a mechanical probe preferably mounted on said machine, and capable of measuring along the length direction of said machine.

18. The method according to claim 11, wherein the step of analyzing said probe data includes determining the height error from a phase error ($B_{pe}$) in the axis of work rotation.

19. The method according to claim 18, wherein said machine comprises a fast tool device carrying said tool and having a fast tool axis inclined with respect to a length axis of said machine, wherein the step of controlling said machine includes controlling, by CNC, said fast tool axis to correct for height errors.

20. The method according to claim 19, wherein the step of probing the cut geometry of said test piece includes probing the latter with a mechanical probe preferably mounted on said machine, and capable of measuring along the length direction of said machine.

* * * * *

UNITED STATES PATENT AND TRADEMARK OFFICE

CERTIFICATE OF CORRECTION

PATENT NO. : 7,440,814 B2
APPLICATION NO. : 11/415048
DATED : October 21, 2008
INVENTOR(S) : Edward McPherson et al.

It is certified that error appears in the above-identified patent and that said Letters Patent is hereby corrected as shown below:

IN THE SPECIFICATION:

Col. 12, Line 44 Underneath "$Y = f(B, \rho) = h \cdot (1 + \sin[a \cdot (\rho - \rho_0)]) \cdot (1 + \sin[nB])$"

Delete " [ 2. and $\left(\frac{-\pi}{2a} \le \rho \le \frac{3\pi}{2a} + \rho_0\right)$ ] "

insert -- 1. for: $\left(\frac{-\pi}{2a} + \rho_0\right) \le \rho \le \left(\frac{3\pi}{2a} + \rho_0\right)$ 2. and $Y = 0$ , elsewhere --

Signed and Sealed this

Sixteenth Day of March, 2010

David J. Kappos

David J. Kappos
*Director of the United States Patent and Trademark Office*